United States Patent [19]

Kasper

[11] 4,393,810

[45] Jul. 19, 1983

[54] ELECTROGRAPHIC DEVELOPMENT APPARATUS AND METHOD HAVING OSCILLATING MAGNETIC CROSS-MIXING

[75] Inventor: George P. Kasper, Rochester, N.Y.

[73] Assignee: Eastman Kodak Company, Rochester, N.Y.

[21] Appl. No.: 380,173

[22] Filed: May 20, 1982

[51] Int. Cl.[3] ..... G03G 15/09

[52] U.S. Cl. ..... 118/657; 430/122; 355/3 DD; 366/349; 366/273

[58] Field of Search ..... 430/122, 125; 355/3 DD; 118/657; 366/349, 273, 274

[56] References Cited

U.S. PATENT DOCUMENTS 3,026,406 3/1962 Blink ..... 366/273 X 4,139,296 2/1979 Ruckdeschel ..... 355/3 DD

OTHER PUBLICATIONS

"Magnetic Cross-Mixing", by J. Fantuzzo, Xerox Disclosure Journal, vol. 5, No. 4, Jul./Aug. 1980, p. 359.

*Primary Examiner*—John D. Welsh

*Attorney, Agent, or Firm*—John D. Husser

[57] ABSTRACT

Electrographic development apparatus of the kind having a developer housing and magnetic means for feeding developer along a path from a supply, to a developing position and back toward the supply includes cross-mix magnet means located proximate a portion of the developer path and means for oscillating the magnet means transversely across the path. In one preferred embodiment the cross-mix magnet and oscillating means are located external of the developer housing.

10 Claims, 4 Drawing Figures

ELECTROGRAPHIC DEVELOPMENT APPARATUS AND METHOD HAVING OSCILLATING MAGNETIC CROSS-MIXING

BACKGROUND OF THE INVENTION

1. Field of the Invention

The present invention relates to apparatus and method for developing an electrographic record medium and more particularly to improved electrographic development structures and techniques for providing thorough developer cross-mixing (i.e. mixing transverse to the movement direction of the record medium being developed).

2. Description of Prior Art

In electrographic reproduction systems, e.g. electrophotography, one common form of image development involves contacting the imaging member (e.g. an electrostatically charged and imagewise exposed photoconductor) with a development mixture comprising toner marking particles and magnetic carrier particles which are selected to triboelectrically charge and attract the toner. The magnetic carrier particles with their triboelectrically attracted toner are magnetically attracted to a rotating brush which moves the development mixture (i.e. developer) from a supply zone to a development zone. There, a portion of the toner is attracted to the imaging member and the remaining toner returns with the developer to the supply zone (where it is remixed and returned for development of subsequent images). The magnetic brush can comprise stationary magnets within a rotating transport cylinder, rotating magnets within a stationary cylinder or devices where both cylinder and magnets rotate.

It is well known that removal of toner from the developer mixture, via image development, shifts the toner to carrier ratio of the mixture. Therefore, it is desirable to monitor the toner concentration carefully, and add toner to the mixture to maintain toner concentration within a limited range of variation. As toner is added it must be quickly mixed evenly throughout the developer in the supply zone, and various mixing means, e.g. transverse feed auger arrangements, are known for this purpose.

In order to maintain consistently good development of solid-area or continuous-tone images (in contrast to line and alpha-numeric images), another difficult problem must be confronted. Specifically, when the imaging member presents a high density, solid or continuous tone image section that extends across only a transverse (with respect to the feed path) portion of the development zone, there is a higher tone depletion from the adjacent transverse portion of the magnetic brush than from other brush portions. This transverse imbalance in toner depletion tends to persist for a period of time that extends into the next image development stages and results in relatively lower development of subsequent image portions that are aligned transversely with the preceding high density image portion.

Various structures and techniques have been suggested for minimizing the image artifact caused by such transient toner concentration imbalances. One prior art technique is to provide transversely slanting magnetic fields within the developer housing to continuously urge developer in one transverse direction as it moves along the development path. The cross-mixing of this technique tends to be slow in response and can cause an unbalanced distribution of developer across the transverse dimension of the development station.

SUMMARY OF THE INVENTION

It is a significant purpose of the present invention to provide electrographic development structure and modes which reduce the undesirable image artifacts caused by transient variations of toner concentration transversely across the development path. One advantage of the present invention is its rapid effectiveness. Another advantage is its simplicity in configuration and operation.

The above and other advantages are accomplished by the present invention which in one aspect provides improved structure for development apparatus of the type having (1) means providing a developer supply zone and (2) magnetic feed means for transporting developer along a developer path from the supply zone to a developing position (adapted to extend transversely across the operative imaging path of electrographic imaging device) and then back toward the supply zone. In one aspect improvements of the present invention include cross-mix magnet means located proximate a portion of the developer path and means for oscillating the cross magnet means transversely across said developer path. In one preferred embodiment of the invention, the development apparatus includes a developer housing having a non-magnetic housing portion extending transversely of, and in closely spaced relation to, the developer path and the cross-mix magnet means are located external of said housing and close to the non-magnetic housing portion.

In another aspect the present invention comprises in the type of electrographic development wherein a toner-carrier developer mixture is magnetically attracted and transported from a housing supply zone along an operative developer path to a developer position and back toward the supply, the improved procedure of attracting toner and carrier mixture along the developer path with a magnetic field, preferably generated external of the housing, and which field oscillates transversely across the developer path.

Because the cross-mixing structure of the present invention is external of the developer housing it is not subject to contamination by the developer and does not require additional access openings into the developer housing.

Although the primary advantages of the present invention are envisioned for developer comprising a mixture of toner and magnetic carrier, the invention can be utilized to advantage also in single-component, magnetic developer systems, e.g. to equalized developer density transversely across the development zone.

BRIEF DESCRIPTION OF THE DRAWINGS

The subsequent description of preferred embodiments of the invention refers to the attached drawings in which.

DETAILED DESCRIPTION OF THE PREFERRED EMBODIMENTS

Figure 1:
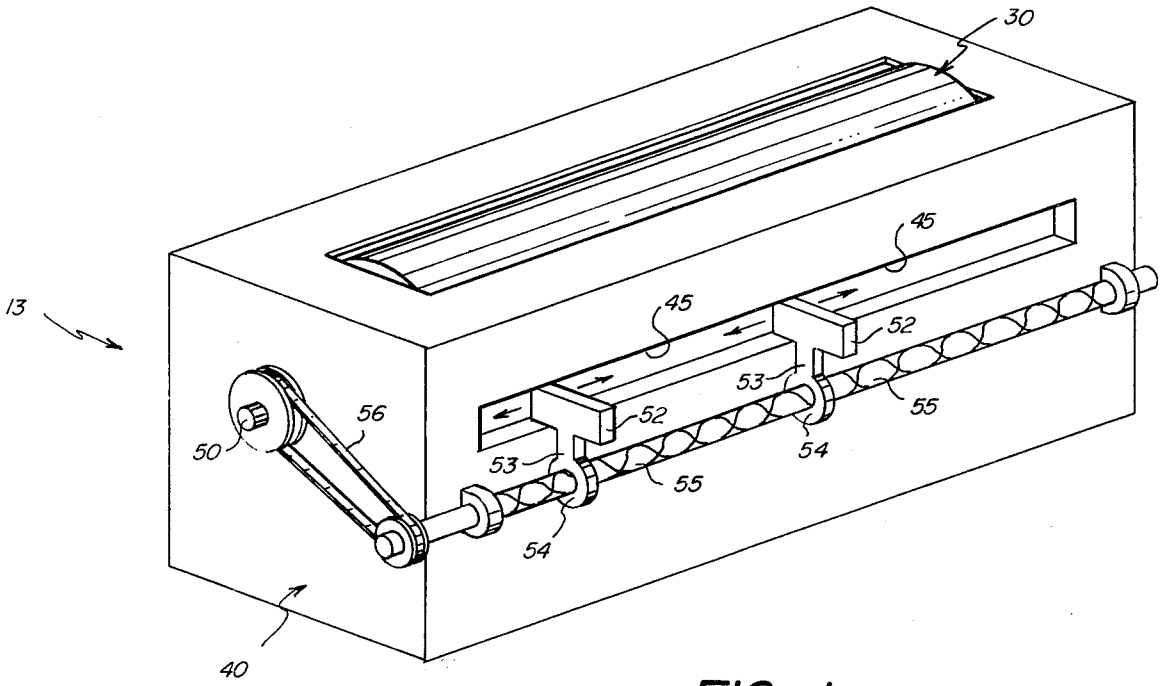
FIG. 1 is a perspective view of one embodiment of development apparatus in accordance with the present invention.
Figure 3:
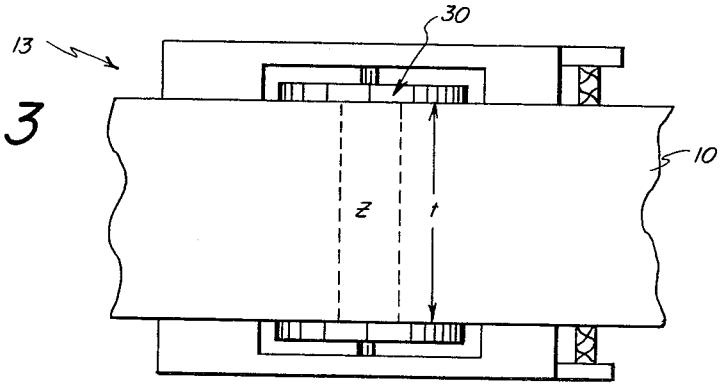
FIG. 3 is a diagrammatic top view of the apparatus shown in FIG. 2.
Figure 2:
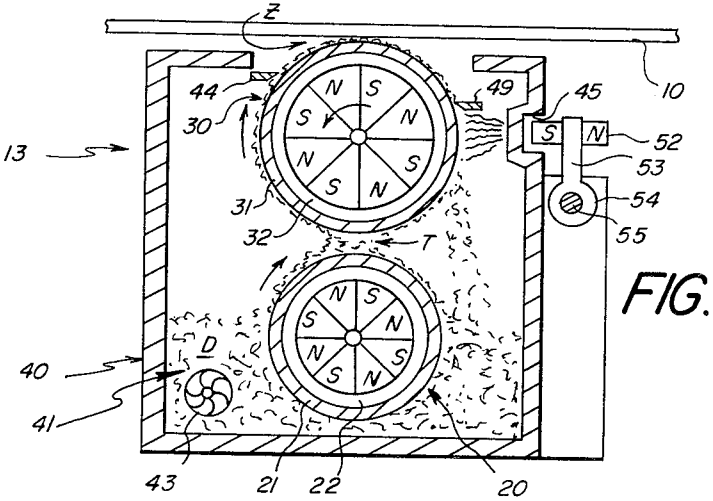
FIG. 2 is a diagrammatic sectional view of the apparatus shown in FIG. 1.

FIGS. 1–3 illustrate one preferred embodiment of electrographic development apparatus in accordance with the present invention. As is well known in the art such apparatus is utilized in a variety of electrographic imaging devices wherein an image member 10 is moved along an operative imaging path that includes a development zone, e.g. shown as Z in FIG. 3. The image member 10 can be a photoconductor which is charged and imagewise exposed to form a latent electrostatic image to be developed, a dielectric member carrying a stylus discharge electrostatic image, a member bearing a conductivity pattern or other known image members of the kind developable with electrographic developer.

The present invention is particularly useful with magnetic brush development apparatus but its principles can be utilized with other development apparatus that transport magnetic developer along an operative development path from a supply zone to a development zone and back toward the supply zone.

The magnetic brush development apparatus 13 comprises a supply brush designated generally 20 and a development brush designated generally 30. Magnetic brush 30 is of the kind having a stationary non-magnetic shell 31 (e.g. formed of aluminum) and a rotatable core 32 of permanent magnets alternating in magnetic polarity (N-S) as indicated in FIG. 2. Magnetic brush 20 has a stationary magnetic core 22 and a non-magnetic shell 21 which is rotated clockwise by drive means 50 to supply developer to brush 30. It will be appreciated that the present invention is useful with other magnetic brush configurations, e.g. those wherein the non-magnetic shell rotates about stationary magnets or where both shell and the magnets rotate. Also it will be appreciated that apparatus configurations using no supply brush or ones having a plurality of brushes defining the development zone can usefully employ the present invention.

The development apparatus 13 comprises a housing 40 which desirably encloses the magnetic brushes, except at the development zone, and provides a supply zone 41 adapted to contain a quantity of developer D. The enclosing characteristic of the housing 40 is important to minimize developer contamination of other parts of the electrographic imaging device, not shown.

The magnetic core 32 is rotated counterclockwise by drive means 50 (see FIG. 1) and such rotation transports developer in the opposite direction (see the peripheral arrow in FIG. 2). Thus it can be seen that the magnetically-attractible carrier of developer D in the supply zone 41 is first attracted by the magnetic fields of the stationary core 22 and transported by shell 21, with its electrostatically bound toner, to a transfer region T with development brush 30. There rotating core 32 attracts the developer and transports it to development position at development zone Z where toner from the mixture develops the electrostatic image on image member 10. Skive 44 is provided to form a smooth nap at the development position. Here it may be useful to repeat that it is desirable that concentration of toner in developer presented by brush 30 be generally equal across the transverse dimension "t" (see FIG. 3) of the development zone Z.

After removal of some toner (depending on the image density) at the development position, the developer moves along a return path back toward the supply zone. It will be appreciated that some developer falls to the supply and some remains attracted to the development brush and is mixed somewhat with new developer supplied by donor roller 20 before repassing to the development zone. Fresh toner is added periodically to replace the expended toner and maintain the general toner concentration of the supply within a predetermined variation range. Auger 43 may be provided to mix developer within the supply; this triboelectrically charges the toner and intermixes newly added toner with residual toner-carrier mixture in the supply zone 41.

To provide rapid reduction in the transient non-uniformities of toner concentration which occur across the transverse dimension "t" of zone Z, the present invention provides a cross-mixing magnetic field which oscillates across the developer path. One preferred configuration for accomplishing this function is shown in FIGS. 1–3. Thus, the housing 40 is constructed with a non-magnetic portion 45 extending transversely across a return portion of the developer path within the housing. As shown best in FIG. 2, the non-magnetic housing portion 45 is located in closely spaced relation to the developer path so that the oscillating magnetic field passing therethrough can strongly attract developer.

In the FIGS. 1–3 embodiment the oscillating magnetic field is provided by magnets 52 which can be e.g., permanent magnets or electromagnets, and which are mounted for translation along the housing portion 45 in closely spaced relation to the external surface of housing portion 45. Each magnet 52 is supported on a follower bracket 53 which has a threaded portion 54 adapted to cooperate with lead screw 55. The lead screw 55 is driven via belt 56 and has a double thread configuration adapted to lead the followers in oscillating movement so that supported magnets 52 traverse back and forth across different regions of housing portion 45.

As illustrated schematically in FIG. 2, the magnets 52 have a strong field which penetrates non-magnetic housing portion 45 and strongly attracts developer moving along the return path of brush 30. The attracted developer forms long chains conforming to the field of the magnets 52, and the magnets shift the chains transversely with respect to the operative development path and thus the transverse dimension "t" of the development zone Z. New developer flow continually breaks chain end portions from the attraction of magnets 52; however, the overall transverse shifting effected by the oscillating magnets has been found highly efficient in rapidly reducing the transient unbalance in toner concentration across the dimension "t" of the development zone. The number of oscillating magnets 52 can be one or more, depending on the speed of oscillation, the operative speed of the photoconductor and the rotational speed of the development brush.

In accord with the embodiment illustrated in FIGS. 1–3, it is preferred to locate the oscillating magnetic field structure to transversely mix developer along the return portion of its operative development path. Also it is preferred to provide skive means 49 at a location upstream of the oscillating magnetic field, although this is not essential. The oscillating field also can be effectively located on the supply path portion of the operative developer path, e.g. upstream of skive 44. (This location would necessitate modification of the housing structure from that shown in FIG. 2.)

Figure 4:
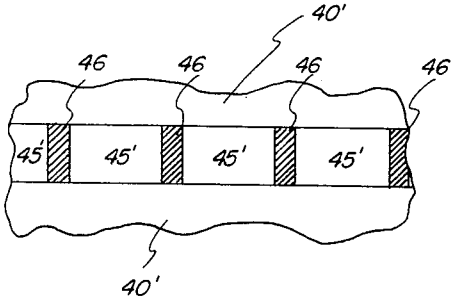
FIG. 4 is a fragmentary view of a portion of development apparatus housing illustrating a modified embodiment of the present invention.

FIG. 4 illustrates another modification useful in accordance with the present invention. In this embodiment housing 40' has a non-magnetic portion 45' that contains magnetic shunt means 46 (e.g. iron strips) spaced along its transversing dimension. By this configuration the attractive force of the magnets 52 are periodically broken during oscillation to release all developer and then attract a different developer portion.

The invention has been described in detail with particular reference to certain preferred embodiments thereof, but it will be understood that variations and modifications can be effected within the spirit and scope of the invention.

What is claimed is:

1. In electrographic development apparatus of the kind adapted for use at a development zone which extends transversely across the operative path of an electrographic imaging device, said development apparatus including means providing a developer supply zone and magnetic brush means for transporting developer along a developer path from said supply zone into a developing position at the development zone and then back toward the developing position or the supply, the improvement comprising:

(a) cross-mix magnet means mounted proximate a transverse portion of said developer path; and (b) means for oscillating said cross-mix magnet means along said developer path portion whereby developer moving past said portion of said developer path is intermixed transversely across said developer path.

2. In electrographic development apparatus of the kind adapted for use at a development zone which extends transversely across the operative path of an electrographic imaging device, said development apparatus including a developer housing providing a supply zone for electrographic developer and magnetic feed means for transporting developer along a developer path from said supply zone to a developing position at the development zone and then back toward the supply zone, the improvement comprising:

(a) a non-magnetic housing portion extending transversely of, and in closely spaced relation to, said developer path at a location displaced from said developing position;

(b) cross-mix magnet means mounted in close relation to said non-magnetic housing portion and on the housing side external with respect to the developer path; and (c) means for oscillating said cross-mix magnet means along said non-magnetic housing portion whereby developer moving along the developer path will be shifted transversely with respect to the operative path of the electrographic imaging device.

3. The invention defined in claim 2 wherein cross-mix magnet means includes a plurality of spaced magnets mounted for oscillating movements respectively along different sectors of said non-magnetic housing portion.

4. The invention defined in claim 2 or 3 wherein said non-magnetic housing portion includes a plurality of magnetic shunt means spaced along its transversing dimension whereby the magnetic attraction of developer by said cross-mix magnet means is intermittently interrupted during such oscillating movement.

5. In electrographic development apparatus of the kind adapted for use at a development zone which extends transversely across the operative path of an electrographic imaging device, said apparatus including (1) a rotatable magnetic brush means for transporting developer along a developer path from a supply zone into a developing position at the development zone and then back to the developing position or the supply zone and (2) a developer housing for substantially enclosing said magnetic brush, said supply zone and said developer path except at said development zone, the improvement comprising:

(a) a non-magnetic housing portion extending transversely of, and in closely spaced relation to, a portion of the developer path which is downstream of said developing position;

(b) cross-mix magnet means mounted in close relation to said non-magnetic housing portion and on the housing side external with respect to said magnetic brush and supply zone; and (c) means for oscillating said cross-mix magnet means along said non-magnetic housing portion in a manner such that developer moving past said downstream position is substantially intermixed, transversely across said developer path.

6. The invention defined in claim 5 wherein cross-mix magnet means includes a plurality of spaced magnets mounted for oscillating movement along different sectors of said non-magnetic housing portion.

7. The invention defined in claim 5 or 6 wherein said non-magnetic housing portion includes a plurality of magnetic shunt means spaced along its transversing dimension whereby the magnetic attraction of said cross-mix magnet on developer is intermittently interrupted during such oscillating movements.

8. The invention defined in claim 5 or 6 further including means located on said developer path, between said developing position and said non-magnetic housing portion, for skiving developer from said magnetic brush.

9. In a method of electrographic development which includes magnetically attracting a developer from the supply portion of a developer housing, transporting the attracted developer along a developer path into a developing relation with an electrographic imaging member and back toward such supply portion, the improvement comprising attracting the developer transported along the developer path with a magnetic field which oscillates transversely across the operative developer path.

10. In a method of electrographic development which includes magnetically attracting a toner-carrier developer mixture from the supply portion of a developer housing, transporting the attracted developer mixture, within said housing, into a developing relation with an electrographic imaging member and then back toward said supply portion, the improvement comprising attracting the toner and carrier mixture flowing along the return path with a magnetic field which is generated external of the developer housing and oscillates transversely across the developer path.

* * * * *